United States Patent [19]

Hughes

[11] 4,109,862

[45] Aug. 29, 1978

[54] SONIC ENERGY TRANSDUCER

[76] Inventor: Nathaniel Hughes, 1934 Sonora Rd., Palm Springs, Calif. 92262

[21] Appl. No.: 785,838

[22] Filed: Apr. 8, 1977

[51] Int. Cl.[2] ..... B05B 17/06

[52] U.S. Cl. ..... 239/102; 239/405; 239/431; 239/470; 261/DIG. 78

[58] Field of Search ..... 261/DIG. 48, DIG. 78; 239/4, 101, 102, 405, 428, 431, 434, 518, 524, DIG. 20, 463, 468–470, 476, 482

[56] References Cited

U.S. PATENT DOCUMENTS

| | | | |
|---|---|---|---|
| 3,064,619 | 11/1962 | Fortman | 239/102 |
| 3,232,267 | 2/1966 | Hughes | 239/102 X |
| 3,256,677 | 6/1966 | Boucher et al. | 239/102 X |
| 3,756,515 | 9/1973 | Arnold | 239/524 |
| 3,778,038 | 12/1973 | Eversole et al. | 261/DIG. 78 X |
| 3,806,029 | 4/1974 | Hughes | 239/102 X |
| 3,958,760 | 5/1976 | Rosenberg | 239/524 X |

FOREIGN PATENT DOCUMENTS

| | | | |
|---|---|---|---|
| 2,201,607 | 8/1972 | Fed. Rep. of Germany | 239/102 |

*Primary Examiner*—Evon C. Blunk
*Assistant Examiner*—Andres Kashnikow
*Attorney, Agent, or Firm*—Christie, Parker & Hale

[57] ABSTRACT

A flow passage having a restriction is connected between a fluid inlet and outlet. A frustum is disposed in the flow passage between the inlet and the restriction. The frustum has a base facing away from the restriction, and an apex facing toward the restriction. The inlet is transverse to the axis of the flow passage and positioned so the base and a portion only of the frustum are directly exposed to the inlet. The frustum is mounted on a rod extending through the flow passage. In one embodiment, a sphere is mounted on the end of the rod beyond the outlet. The rod may be hollow and have holes near the restriction for the purpose of liquid feed.

25 Claims, 4 Drawing Figures

SONIC ENERGY TRANSDUCER

BACKGROUND OF THE INVENTION

This invention relates to sonic energy generation and, more particularly, to an improved sonic energy transducer employing a supersonic nozzle.

In one class of sonic energy transducer, sonic waves are generated by accelerating a gas to supersonic velocity in a nozzle. To achieve supersonic flow it has been necessary in the past to establish a large pressure drop from the inlet to the outlet of the nozzle. In order to produce sufficiently high energy levels for effective atomization and other purposes, prior art sonic energy transducers have used a resonator beyond the outlet of the supersonic nozzle, as disclosed in my U.S. Pat. No. 3,230,924, which issued Jan. 25, 1966, or a sphere in the diverging section of the supersonic nozzle, as disclosed in my U.S. Pat. No. 3,806,029, which issued Apr. 23, 1974.

SUMMARY OF THE INVENTION

The invention produces supersonic flow and higher energy levels with a lower pressure drop than prior art sonic energy transducers employing supersonic nozzles. Resonators or spheres are not required to produce high energy levels, although a sphere may be advantageously employed to increase the level of energization under some circumstances.

According to one feature of the invention, a flow passage is formed between an inlet and an outlet, which opens into a region at ambient pressure. A source of gas under pressure larger than the ambient pressure is connected to the inlet to induce gas movement through the flow passage along a flow axis. A rotational motion about the flow axis is imparted to the gas in the flow passage, and the gas in the flow passage is accelerated to supersonic velocity in the direction of the flow axis to emit three dimensional sound energy from the outlet into the region at ambient pressure.

A feature of the invention is the use of a frustum to impart rotational motion to the gas. The frustum is located in the flow passage between the inlet and a restriction that accelerates the gas in the flow passage to supersonic velocity in the direction of the flow axis. Preferably, the inlet is transverse to the flow axis and is positioned so the base and a portion only of the frustum are directly exposed to the inlet.

Another feature of the invention is the use of a rod extending along the length of the flow passage to impart rotational motion to the gas and force the gas outwardly from the flow axis. In one embodiment, one end of the rod extends beyond the outlet and a sphere is mounted thereon. The rod can also serve to support the frustum and to feed liquid to the restriction for atomization.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
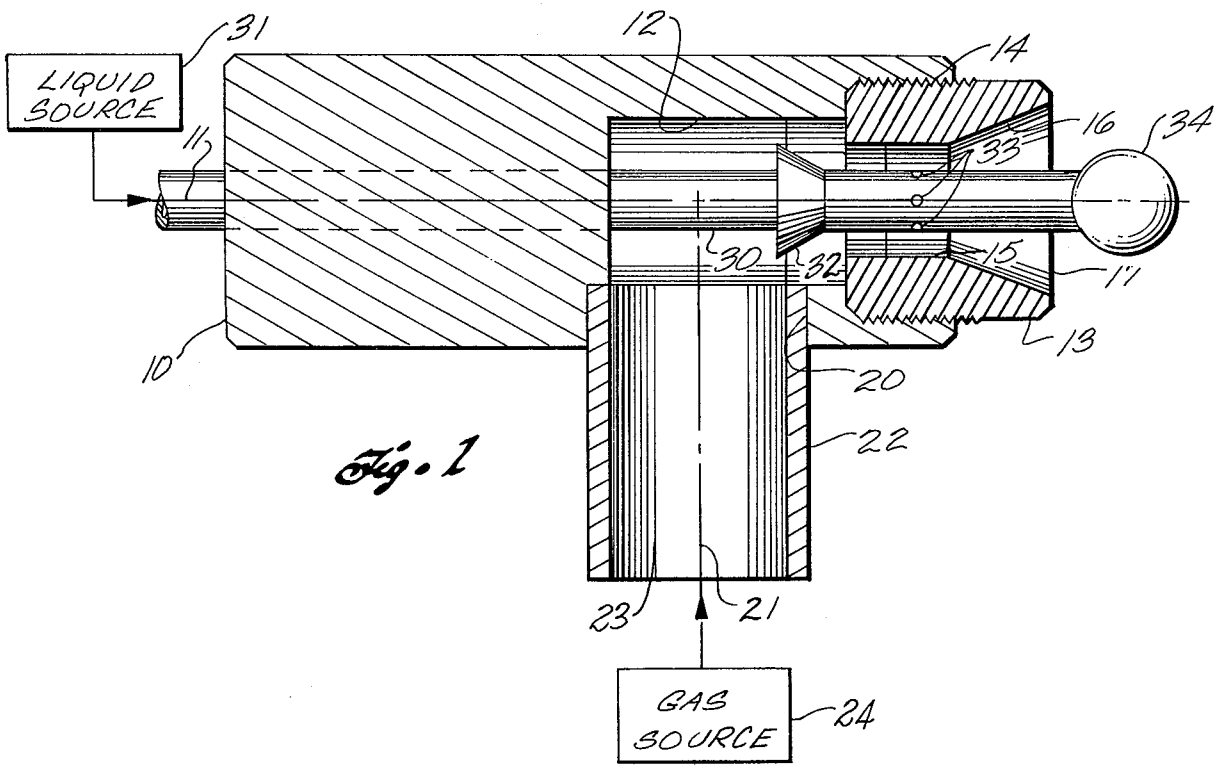
FIG. 1 is a side sectional view of a sonic energy transducer incorporating the principles of the invention.

In FIG. 1, a cylindrical transducer body 10 has a cylindrical axis 11. A cylindrical bore 12 is formed in one end of body 10 in alignment with axis 11. A nozzle 13 is secured in a counterbore at the open end of bore 12 by a threaded connection 14. Adjacent to bore 12, nozzle 13 has a cylindrical section 15 having a smaller cross-sectional area than bore 12. A divergent section 16 joins section 15 to an outlet 17 of the transducer, which opens into a region at ambient pressure. Cylindrical section 15 and diverging section 16 are aligned with axis 11.

A cylindrical bore 20 formed in the side of body 10 meets bore 12. Bore 20 has a cylindrical axis 21 that intersects axis 11 at a right angle. A cylindrical tube 22 fits inside bore 20, where it is secured to body 10 by welding, or the like. The inside of tube 22 serves as an inlet 23 of the transducer. A gas source 24 is connected to inlet 23. The gas from source 24 is under a pressure higher than the ambient pressure in the region into which outlet 17 opens.

A hollow rod 30 extends through body 10, including bore 12 and nozzle 13, in alignment with axis 11. For support and connection to a liquid source 31, rod 30 fits in a bore between bore 12 and the end of body 10 opposite to nozzle 13. A frustum 32 is mounted on rod 30 between inlet 23 and nozzle 13. Frustum 32 has a base facing away from nozzle 13 and an apex facing toward nozzle 13. As shown in FIG. 1, the base of frustum 32 is substantially adjacent to inlet 23, more specifically frustum 32 is axially positioned so its base and a portion only thereof are directly exposed to inlet 23, i.e., in a direct line of gas flowing through inlet 23 into bore 12. A plurality, e.g., four, liquid feed holes 33 are formed in rod 30 within cylindrical section 15. One end of rod 30 extends beyond outlet 17, where a sphere 34 is mounted thereon.

Figure 4:
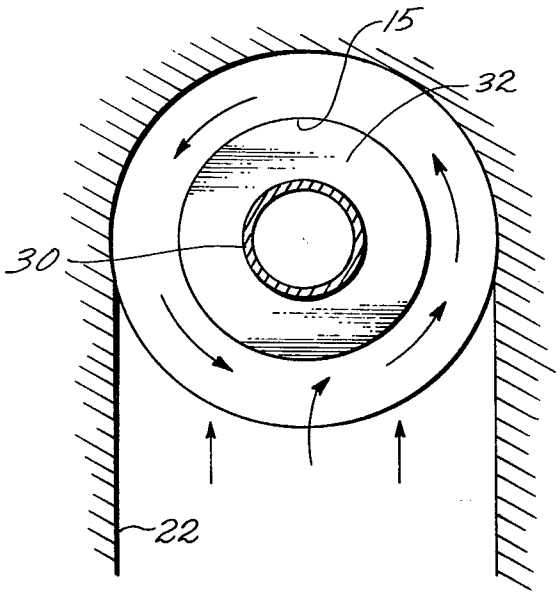
FIG. 4 is a schematic diagram showing the gas flow direction of the sonic energy transducer of FIG. 1 in a plane 90° to that of FIG. 3.
Figure 3:
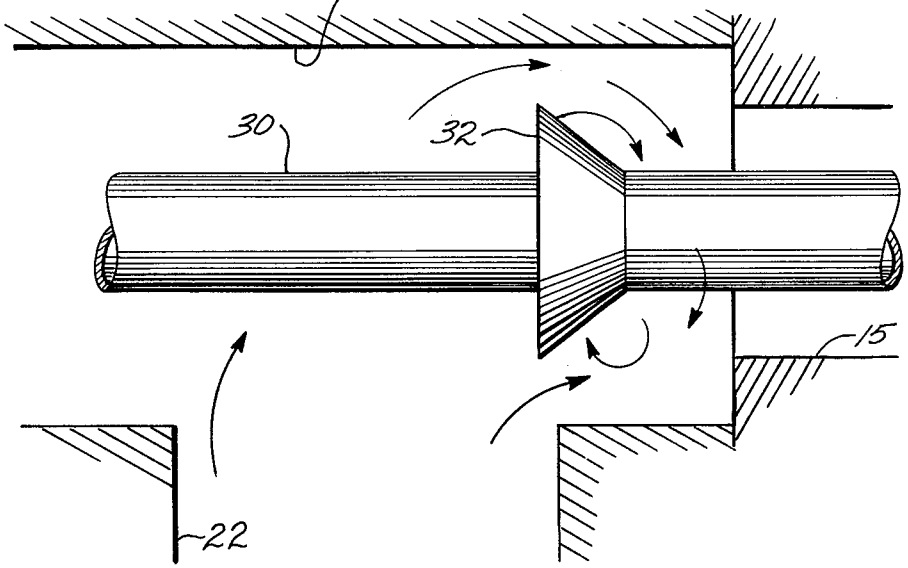
FIG. 3 is a schematic diagram showing the gas flow direction in the sonic energy transducer of FIG. 1.

In operation, the gas from source 24 flows through inlet tube 22 to impinge upon rod 30 and only a portion of frustum 32 in a direction transverse to axis 11. Bore 12, cylindrical section 15, and diverging section 16 form a flow passage between inlet tube 22 and outlet 17. Nozzle 13, including cylindrical section 15 and diverging section 16, forms a restriction in this flow passage, and axis 11 serves as a common flow axis along and about which gas from source 24 flows to outlet 17. Frustum 32 and, to a lesser extent, rod 30 impart a rotational motion about axis 11 to the gas, as illustrated in FIGS. 3 and 4. Consequently, a gas vortex flows through the flow passage from left to right as viewed in FIG. 1. The direction of rotation is counterclockwise, as viewed from left to right in FIG. 1. This vortex produces in cylindrical section 15 a subatmospheric pressure related to the superatmospheric pressure of source 24, i.e., the higher the superatmospheric pressure of source 24 the lower is the absolute pressure in cylindrical section 15, until absolute zero pressure is reached. The vortex produces by rotation strong centrifugal forces and an atomizational effect not unlike that produced by a centrifuge. For each value of gas source pressure, there is a null point of minimum subatmospheric pressure along axis 11. This vortex provides a sufficient pressure drop to establish the critical pressure ratio for supersonic flow between source 24 and cylindrical setion 15 with a much lower value of gas source pressure than the prior art. The gas flowing through nozzle 13 is, therefore, accelerated to supersonic velocity in the direction of the common flow axis, while such gas is rotating about the common flow axis. As a result, a three dimensional sonic wave is produced beyond outlet 17. The intensity of this sonic wave is enhanced by sphere 34. The intensity of the sonic energy is also believed to be enhanced by a beating, mixing, or heterodyning of the rather low frequency associated with the rotational component of the gas motion, i.e., the gas vortex flow about the common axis, and the rather high frequency associated with the translational component of the gas motion, i.e., the gas motion in the direction of the common flow axis.

Cylindrical section 15 provides an advantageous point for the introduction of a liquid to be atomized, such as gasoline, paint, chemical sprays, etc., because of the subatmospheric pressure created there by the gas vortex. Such location of the liquid feed produces a pumping action on source 31 due to the subatmospheric pressure, which draws the liquid into the gas stream through holes 33 and efficiently atomizes and/or vaporizes the liquid. The location of the feed holes at section 15 also promotes cavitation of the liquid, which further enhances atomization.

Rod 30 serves a number of functions. First, it serves as a drag member to aid in the formation of the gas vortex. Second, it increases the energy density in the flow passage by reducing the cross-sectional area. Third, it moves the bulk of the gas particles flowing through the flow passage to the circumference thereof to stabilize the boundary layer and produce a concentric shock pattern. The characteristics of the transducer can be changed by substituting a new rod having a different diameter for rod 30.

Frustum 32 serves as a drag member to form the gas vortex along rod 30. The rotational motion of this gas vortex stabilizes the boundary layers within the flow passage, thereby promoting more efficient acceleration to supersonic velocity. The characteristics of the transducer can also be changed by substituting a frustum having a different base diameter and/or half-angle for frustum 32.

The drag presented by frustum 32 is increased by directing the inlet gas toward frustum 32 at 90° to its axis rather than parallel to its axis. The protrusion of the base of frustum 32 into the path of inlet 23 creates a larger opening on the lower one-third of the circumference of frustum 32 than the remaining two-thirds. The resulting difference in flow resistance promotes the rotational motion of the gas. Thus, frustum 32 is an efficient dynamic drag member, because it converts the static pressure of the gas in inlet 23 into rotational motion in bore 12. The bottom one-third of the base of frustum 32 also functions as a knife edge in the gas flow stream entering bore 12 from inlet 23, thereby further enhancing the gas vortex and the sonic energy generation.

Sphere 34 also serves as a drag member in the path of the sonic waves emanating from outlet 17. Unlike the sphere within the nozzle shown in my U.S. Pat. No. 3,806,029, the position of sphere 34 beyond outlet 17 is not critical. In many applications, sphere 34 can be dispensed with entirely without adversely affecting the sonic energy level.

Figure 2:
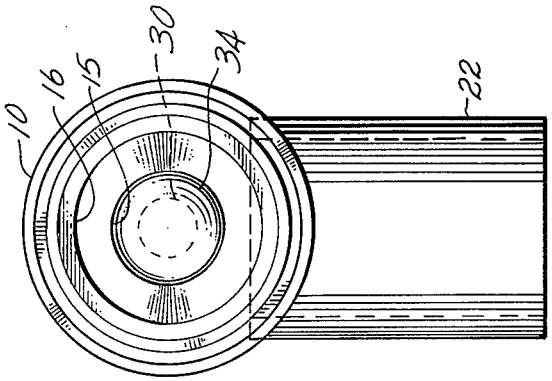
FIG. 2 is a front plan view of the sonic energy transducer of FIG. 1.

In a typical example, the transducer of FIGS. 1 and 2 would have the following dimensions: diameter of inlet 23 — 0.312 inches; diameter of bore 12 — 0.312 inches; length of bore 12 — 0.312 inches; diameter of section 15 — 0.200 inches; length of section 15 — 0.162 inches; diameter of section 16 at outlet 17 — 0.295 inches; half-angle of section 16 — 15° to axis 11; length of section 16 — 0.166 inches; diameter of rod 30 —0.093 inches; base of frustum 32 — 0.200 inches; half-angle of frustum 32 — 34.6°; length of frustum 32 — 0.069 inches; diameter of sphere 34 — 0.1875 inches; spacing from outlet 17 to the center of sphere 34 — 0.100 inches; spacing from the base of frustum 32 to the inside surface of tube 22 along a line parallel to axis 11 — 0.020 inches.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, although it is preferred for inlet 23 to be transverse to the flow axis, it could be aligned therewith as in conventional nozzles; although it is preferred to form the vortex in part with a frustum, the frustum could be eliminated leaving the rod to perform this function; the sphere beyond the outlet of the transducer could be eliminated in many cases without adverse consequences upon the energy level; although it is preferable to feed liquid to cylindrical section 15, liquid could be atomized at other points, e.g., at outlet 17, or if the transducer is not used for atomization, source 31 could be eliminated altogether; and although the disclosed form of the restriction is preferred, other types of restrictions could be utilized such as converging-diverging sections, coverging-cylindrical-diverging sections, or a diverging section alone. It is contemplated in some applications that the ambient pressure in the region into which the outlet of the transducer opens is a subatmospheric pressure, i.e., in the intake manifold of an internal combustion engine; in such case, source 24 could be at atmospheric pressure, i.e., source 24 could be the atmosphere. The invention can also be used to energize liquids, i.e., source 24 could be a liquid rather than a gas.

What is claimed is:

1. A sonic energy transducer comprising:

a fluid inlet;

a fluid outlet;

a flow passage having a restriction between the inlet and the outlet;

a hollow rod extending along the passage, the rod having one or more holes near the restriction;

a frustum mounted on the rod in the flow passage between the inlet and the restriction, the frustum having a base facing away from the restriction and an apex facing toward the restriction; and a source of liquid to be atomized connected to the rod to feed the liquid to the restriction.

2. The sonic energy transducer of claim 1, in which the flow passage, the frustum, the restriction, and the outlet are aligned with a common flow axis, and the inlet is aligned with an axis at an angle to the common flow axis.

3. The sonic energy transducer of claim 2, in which the inlet is positioned such that the base and a portion only of the frustum are exposed to the inlet.

4. The sonic energy transducer of claim 1, in which the flow passage has a given cross-sectional area and the restriction comprises a cylindrical section having a cross-sectional area smaller than the given cross-sectional area, and a diverging section joining the cylindrical section to the outlet.

5. The sonic energy transducer of claim 4, in which the rod extends through the flow passage from end to end.

6. The sonic energy transducer of claim 1, in which the flow passage, the frustum, the restriction, and the outlet are aligned with a common flow axis, and the inlet is aligned with an axis that intersects the common flow axis at a 90° angle.

7. The sonic energy transducer of claim 6, in which the base of the frustum is substantially adjacent to the inlet.

8. The sonic energy transducer of claim 1, in which the frustum is disposed in the flow passage between the inlet and the restriction without extending into the restriction.

9. The sonic energy transducer of claim 8, in which the frustum and the rod are fixed.

10. The sonic energy transducer of claim 1, in which the frustum and the rod are fixed.

11. The sonic energy transducer of claim 1, in which the flow passage has a given cross-sectional area and the restriction comprises a cylindrical section having a cross-sectional area smaller than the given cross-sectional area.

12. The sonic energy transducer of claim 11, in which the restriction further comprises a diverging section joining the cylindrical section to the outlet.

13. A sonic energy transducer comprising:

a flow passage having a restriction in alignment with a flow axis;

a hollow, fixed rod extending along the flow passage in alignment with the flow axis, the rod having one or more holes near the restriction;

a fluid inlet connected to the flow passage on one side of the restriction, the fluid inlet being aligned with an axis transverse to the common flow axis and intersecting the rod and being so positioned relative to the rod and the restriction to form a vortex in the passage when gas is supplied to the inlet;

a fluid outlet connected to the flow passage on the other side of the restriction; and a source of liquid to be atomized connected to the rod to feed the liquid to the restriction.

14. The sonic energy transducer of claim 13 in which the rod extends along the flow passage from end to end.

15. The sonic energy transducer of claim 13, in which the flow passage has a given cross-sectional area, and the restriction comprises a cylindrical section having a cross-sectional area smaller than the given cross-sectional area.

16. A sonic energy transducer comprising:

a fluid inlet;

a fluid outlet;

a flow passage having a given cross-sectional area;

a restriction in the flow passage between the inlet and the outlet comprising a cylindrical section having a cross-sectional area smaller than the given cross-sectional area, the flow passage, the frustum, the restriction, and the outlet being aligned with a common flow axis and the inlet being aligned with an inlet axis that intersects the common flow axis at an angle; and a frustum disposed in the flow passage between the inlet and the restriction, the frustum having a base facing away from the restriction and an apex facing toward the restriction.

17. The sonic energy transducer of claim 16, additionally comprising a rod aligned with the common flow axis in the flow passage, the frustum being mounted on the rod.

18. The sonic energy transducer of claim 17, in which the rod extends through the flow passage from end to end.

19. The sonic energy transducer of claim 17, in which the rod is hollow and has one or more holes near the restriction, the transducer additionally comprising a source of liquid to be atomized connected to the rod to feed liquid to the restriction.

20. The sonic energy transducer of claim 16, in which the frustum is disposed in the flow passage between the inlet and the restriction without extending into the restriction.

21. The sonic energy transducer of claim 16, in which the frustum is fixed.

22. The sonic energy transducer of claim 16, in which the restriction additionally comprises a diverging section joining the cylindrical section to the outlet.

23. The sonic energy transducer of claim 16, in which the angle at which the inlet axis intersects the common flow axis is a 90° angle.

24. The sonic energy transducer of claim 16, in which the inlet is positioned such that the base and a portion only of the frustum are exposed to the inlet.

25. The sonic energy transducer of claim 16, in which the base of the frustum is substantially adjacent to the inlet.

* * * * *

UNITED STATES PATENT AND TRADEMARK OFFICE

CERTIFICATE OF CORRECTION

PATENT NO. : 4,109,862

DATED : August 29, 1978

INVENTOR(S) : Nathaniel Hughes

It is certified that error appears in the above-identified patent and that said Letters Patent are hereby corrected as shown below:

Col. 4, lines 6 & 7,"hal-f:angle" should be --half-angle--.

Claim 16 should read:

A sonic energy transducer comprising:
a fluid inlet;
a fluid outlet;
a flow passage having a given cross-sectional area;
a restriction in the flow passage between the inlet and the outlet comprising a cylindrical section having a cross-sectional area smaller than the given cross-sectional area [, the flow passage, the frustum, the restriction, and the outlet being aligned with a common flow axis and the inlet being aligned with an inlet axis that intersects the common flow axis at an angle]; and
a frustum disposed in the flow passage between the inlet and the restriction, the frustum having a base facing away from the restriction and an apex facing toward the restriction, the flow passage, the frustum, the restriction, and the outlet being aligned with a common flow axis and the inlet being aligned with an inlet axis that intersects the common flow axis at an angle.

Signed and Sealed this

First Day of May 1979

[SEAL]

Attest:

RUTH C. MASON
Attesting Officer

DONALD W. BANNER
Commissioner of Patents and Trademarks